United States Patent [19]

Shumate

[11] 4,087,216

[45] May 2, 1978

[54] FLOW DIVERTER PRESSURE PLATE

[75] Inventor: Donald L. Shumate, Streetsboro, Ohio

[73] Assignee: Permco, Inc., Streetsboro, Ohio

[21] Appl. No.: 729,782

[22] Filed: Oct. 5, 1976

[51] Int. Cl.[2] ..... F04C 27/00; F04C 29/00

[52] U.S. Cl. ..... 418/74; 418/131

[58] Field of Search ..... 418/71, 72, 73, 74, 418/78, 126, 131, 132, 133

[56] References Cited

U.S. PATENT DOCUMENTS

| | | | |
|---|---|---|---|
| 2,624,287 | 1/1953 | Ilyin | 418/78 |
| 2,626,570 | 1/1953 | Armington et al. | 418/74 |
| 2,824,524 | 2/1958 | Banker | 418/133 X |
| 3,029,739 | 4/1962 | Nagely | 418/132 X |
| 3,474,736 | 10/1969 | Lauck | 418/74 |
| 3,781,149 | 12/1973 | Weaver et al. | 418/131 |
| 3,964,844 | 6/1976 | Whitmore | 418/133 |

*Primary Examiner*—Carlton R. Croyle
*Assistant Examiner*—Leonard Smith
*Attorney, Agent, or Firm*—Watts, Hoffmann, Fisher & Heinke Co.

[57] ABSTRACT

Method and apparatus are disclosed for counterbalancing the high pressure forces normally generated in the high pressure fluid region of a rotary pump or motor and exerted against the rotating structure of the pump or motor. By this method and apparatus a portion of the fluid in the high pressure region of the pump housing is transported to a region of the housing interior adjacent to, but out of communication with the low pressure fluid region. This transported high pressure fluid is directed against the rotating structure in the direction of the high pressure fluid region. Consequently, the rotating structure of the pump or motor is less subject to distortion or displacement due to forces generated by fluid in the housing's high pressure fluid region.

7 Claims, 6 Drawing Figures

FLOW DIVERTER PRESSURE PLATE

BACKGROUND OF THE INVENTION

Rotary fluid pumps and motors transport fluid between distinct pressure regions. Such pumps and motors are characterized by housings having low and high pressure fluid delivery ports. Fluid pressure knows no preferred direction and acts uniformly in all directions. High pressure fluid at and in the vicinity of the high pressure port of such a pump exerts a force against the pump or motor's rotary structure in the direction of the low pressure port which force tends to displace and/or flex the rotary structure toward the low pressure port resulting in aggravated bearing wear and failure, housing wear, and perhaps even failure of the housing.

The invention is particularly concerned with rotary gear pumps such as shown, for example, in U.S. Pat. No. 2,714,856. Gear pumps of the character to which the invention relates typically comprise a housing which has a low pressure fluid inlet port and a high pressure fluid outlet port, mating driving and driven gear impellers mounted in the housing between the inlet and the outlet ports by integral hubs projecting from opposite sides of the impellers supported within the housing by needle bearings and side or end plates mounted in the housing at opposite sides or ends of the impellers.

Gear pumps or motors as described above typically have a pumping capacity of up to 50 gallons per minute. Impellers for these gear pumps generally have widths in the range from ½ to 3 inches. Gear pumps capable of higher pumping capacity provide a quicker, stronger response to the load in a given hydraulic system and require more surface area and generally tend to have wider impellers. For a given pump pressure, a larger surface area results in a greater force being applied against the impellers and therefore a greater load on the bearings supporting the impeller structures.

The efficiency of gear pumps is dependent in part on the housing interior surface closely conforming to the profile of the adjacent impellers. The total clearance between the impellers and the interior surface is typically no more than 0.003 inches. Consequently, it is important that the impellers run true within the housing, to avoid interference with the adjacent housing interior.

The high pressure fluid exhausting from the pump outlet exerts a force against the mating impellers in the direction of the low pressure inlet. The size of this force is determined by the amount of pressure at the pump outlet and the impeller surface area against which this high pressure may act. The high pressure generated tends to deflect the impeller structures in the direction of the low pressure inlet. The needle bearings which support the impeller hubs are forced out of full surface contact or load and into edge contact with the hubs. Once the needle bearings loose full surface contact or load with the hubs, pump failure is inevitable. The needle bearings dig into the hubs along one of their edges to cause spalling on the adjacent hub surface. The spalling creates an aggravated wear condition resulting from the interaction of the chips of material displaced from the hub with the relatively rotating parts of the pump and the needle bearings.

The displacement of material from the hubs by the needle bearings destroys the close tolerance fit at the impeller supporting structure. Since the clearance between the impellers and the housing is relatively small, a small amount of spalling creates sufficient play so the impellers can be displaced against the interior surfaces of the housing. When the impellers do contact the interior surfaces of the housing, they gouge that surface. Consequently, the housing interior surface wears and leakage results. If the fluid pressure at the pump outlet is sufficiently great, it is actually possible for the displaced impellers to fracture the housing.

The problems of uneven pressure distribution in a gear pump can be further aggravated by the environment in which the pump is used. In coal mines gear pumps are frequently used in hydraulic systems. These gear pumps usually pump, and are lubricated by, an oil-water mixture known as fireproof oil. The oil-water mixture is employed to minimize fire hazards within the mine. Because oil is mixed with water, the lubrication quality of this mixture is less than unadulterated oil. Consequently, the load rating is reduced for needle bearings in pumps utilized in such an environment. The problem is further aggravated by the practical consequences of operating in a mine environment. Workers in a mine do not rigorously replenish the fireproof oil supply in the proper oil-to-water proportion. Initially, fire-proof oil contain 80% oil and 20% water. As the fireproof oil reservoir is depleted, it is a common practice to merely add more water to the reservoir. Consequently, the lubrication quality of the fire-proof oil diminishes and the life of the pump is shortened as the load rating on the needle bearings is further reduced.

Gear pumps lubricated with fire-proof oil in a mine environment undergo tremendous wear. Usually these pumps are not fit to rebuild and there is usually nothing worth salvaging upon teardown. If these pumps are run at 1500 psi, they may last for approximately 3 months. If these pumps run at 2000 psi, they may last for a month. With higher pressures their life expectancy is even less.

SUMMARY OF THE INVENTION

It is an object of this invention to provide means for reducing the uneven load which is applied to the rotary structure in rotary fluid pumps and motors by high pressure generated forces acting in the direction of the low pressure fluid port.

The present invention provides for counterbalancing high pressure forces exerted against power actuated pumping means rotatably mounted in a pump or motor housing having opposed low pressure and high pressure sides on opposite sides of the pumping means and discrete end plates at opposite ends of the pumping means. The low pressure side includes a low pressure fluid delivery port and the high pressure side includes a high pressure fluid delivery port. Reaction chamber means are provided in the end plates which are exposed to the rotatably mounted pumping means adjacent to but spaced from the low pressure side. The reaction chamber means are isolated from the inlet port and means are provided in the end plates for communicating fluid between the outlet port and the reaction chamber means. High pressure fluid acting on high pressure side of the rotating pump structure can thus be diverted to the reaction chamber means to maintain the pumping means in a fluid pressure balanced condition.

In the depicted embodiment of this invention the power actuated pumping means comprises gear impellers. The housing includes end plates on opposite ends of the impellers. The end plates have high pressure sides exposed to the outlet port and low pressure sides exposed to the inlet port. The reaction chamber means is located on the low pressure side of the end plates.

In another aspect of this invention, a method is disclosed for counterbalancing high pressure forces in a pump or motor having a housing with opposed high and low pressure sides and respective fluid delivery ports. The pump or motor includes a pumping structure mounted for rotation within the housing to direct fluid from one port to the other. The high pressure forces are generated by high pressure fluid on the high pressure side of the housing acting against the rotating structure and in the direction of the low pressure side. The method comprises the steps of channeling a portion of the high pressure fluid from the high pressure fluid port to a region of the housing interior adjacent to, but out of communication with, the low pressure fluid port and directing the channeled high pressure fluid against the rotating structure and in the direction of the high pressure side of the housing.

Other advantages and a fuller understanding of the invention will be had from the following detailed description and the accompanying drawing.

DESCRIPTION OF THE PREFERRED EMBODIMENTS

Figure 1:
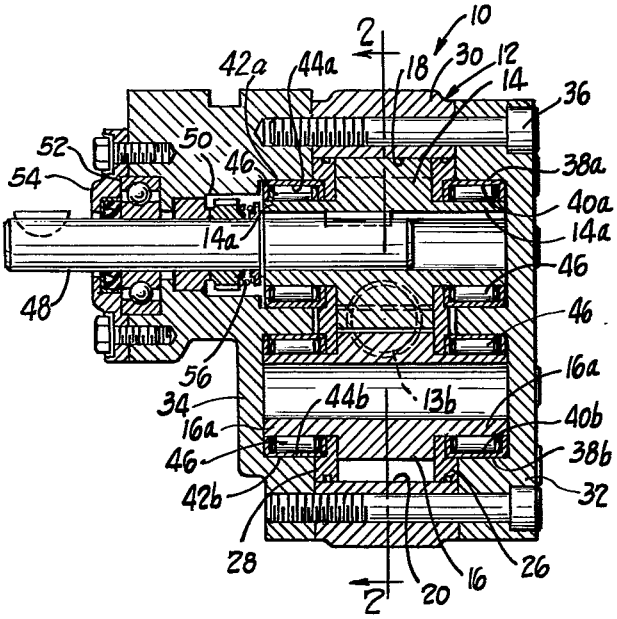
FIG. 1 is a vertical cross-sectional view of a rotary gear pump or motor taken on the line 1—1 of FIG. 2.
Figure 2:
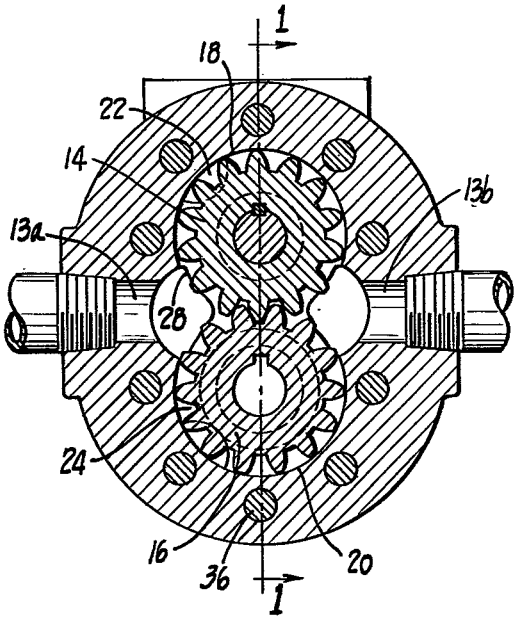
FIG. 2 is a sectional view taken on the line 2—2 of FIG. 1.

Referring to the drawings and particularly to FIGS. 1 and 2, there is shown a gear pump 10 that is also usable as a motor. The pump or motor 10 comprises a housing 12 which includes a low pressure fluid inlet port 13*a* and a high pressure fluid outlet port 13*b*.

In accordance with conventional practice the housing 12 supports mating driving and driven gear impellers 14, 16 provided with integral hubs 14*a*, 16*a*, respectively, of reduced diameter at opposite sides of the impellers to form impeller structures which are rotatably mounted within the housing with the impellers 14, 16 in communication with both the inlet port and the outlet port 13*a*, 13*b*. The housing interior has arcuate gear chamber surfaces 18, 20 between which the impellers 14, 16 are mounted. Each of the surfaces 18, 20 closely conforms to the curvature of the adjacent impeller 14, 16. A pair of end plates 26, 28 are disposed in the housing at opposite ends of the gear impellers 14, 16. The end plates 26, 28 cooperate with the housing surfaces 18, 20 to form gear chambers 22, 24 for the impellers 14, 16 respectively.

The housing 12 includes a central casing member 30 and a pair of end casing members 32, 34. A plurality of bolts 36 are provided which extend through the casing members 30, 32 and screw into the casing member 34 to hold the casing members 30, 32, 34 together in tightly sealed relation.

The interior of the central casing member 30 contains the opposed arcuate housing surfaces 18, 20. The central casing member 30 also contains the fluid inlet and outlet ports 13*a*, 13*b*.

The hub portions 14*a* of the driving gear impeller 14 extend from opposite sides thereof, that is, from opposite sides of the toothed central portion of the impeller structure into aligned circular recesses 38*a*, 42*a*, in the end casing members 32, 34 respectively. The driven impeller structure is similarly constructed and the integral hub portions 16*a* thereof extend into aligned circular recesses 38*b*, 42*b* in the end casing members 32, 34 respectively. The hub portions 14*a*, 16*a* are centrally supported in the recesses 38*a*, 38*b*, 42*a*, 42*b* by needle bearing assemblies 46.

The impeller structures are hollow. The impeller structure including the driving impeller 14 is adapted to receive a drive shaft 48. A shaft opening 50 in the end casing member 34 communicates with the circular recess 42*a*. The drive shaft 48 extends through the opening 50 and provides means by which power may be imparted to the driving impeller 14 from exterior of the housing 10. The drive shaft 48 is supported for rotation within the opening 50 by means of a roller bearing 52 also fitted in a circular recess in the end casing member 34. The roller bearing 52 is retained in the casing member 34 by means of a bolt-on bearing retainer 54. Conventional sealing means 56 are disposed about the shaft 48 between the end casing member 34 and the end of the impeller structure including the impeller 14 to seal the shaft 48 and prevent escape of fluid between the shaft and the end casing member 34.

Each of the end plates include conduit means providing for the flow of a limited amount of fluid from the high pressure sides of the meshing impellers to the opposite sides thereof for the utilization of a portion of the high pressure fluid in the pump housing to generate counter-balancing forces which act against the impeller structures in a direction opposite to that of forces generated by the bulk of the high pressure fluid which is located proximate the high pressure port of the pump housing. The generation of these counter-balancing forces is significant because these counter-balancing forces reduce the imbalance on the rotating impeller structures thus reducing flexing thereof and the resulting imbalance on the needle bearings 46 interferring with the maintenance of full surface contact and load with the adjacent hubs of the impeller structure. Consequently, the pump life is prolonged for periods substantially in excess of what has been previously possible.

Figure 3:
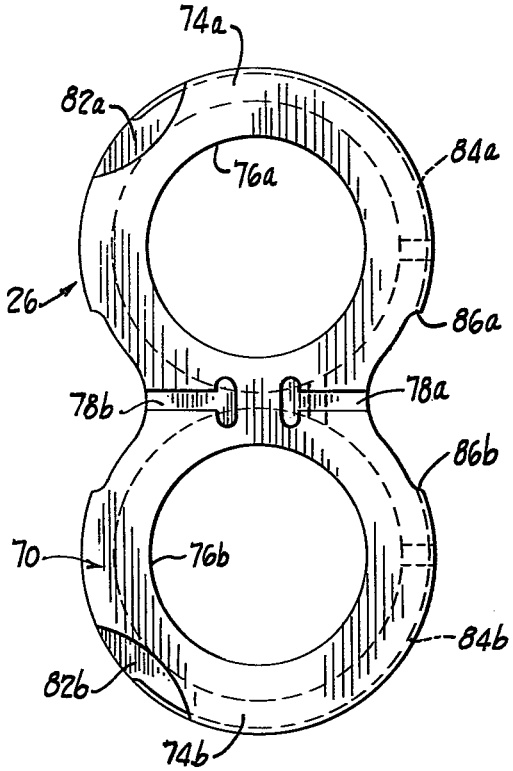
FIG. 3 is an elevational view of an improved end plate incorporating features of this invention.
Figure 4:
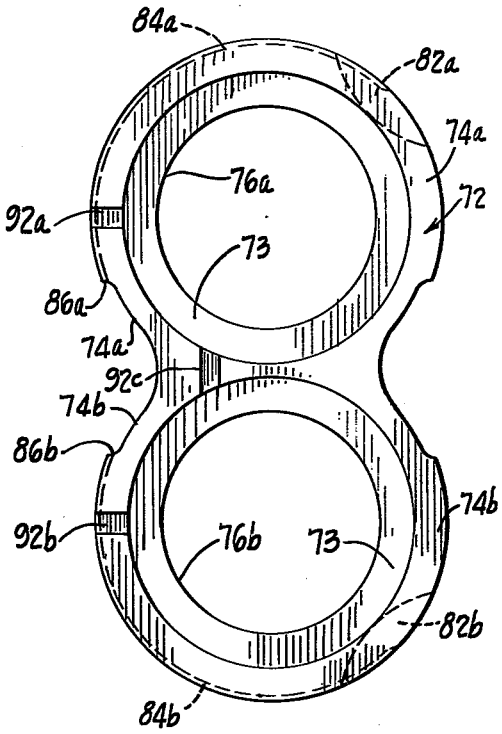
FIG. 4 is an elevational view of the opposed face of the end plate illustrated in FIG. 3.
Figure 5:
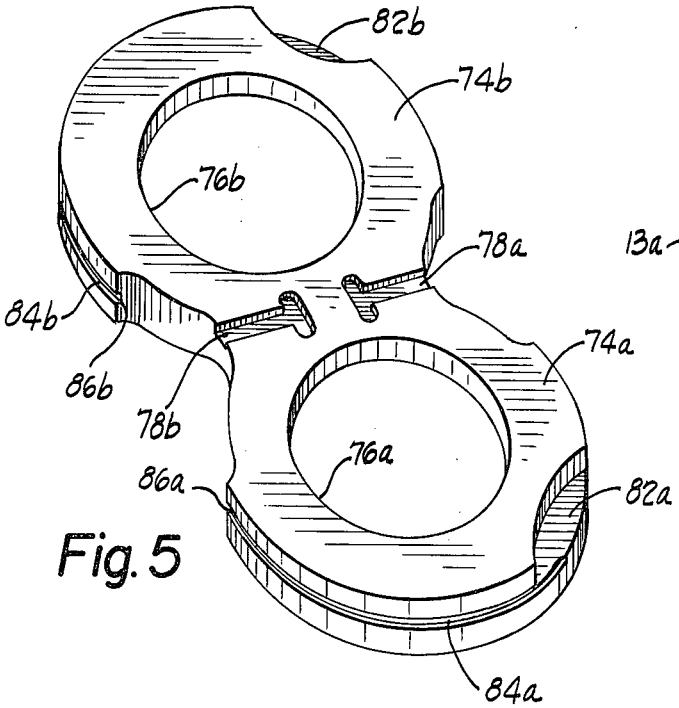
FIG. 5 is a perspective view of the end plate illustrated in FIG. 3.
Figure 6:
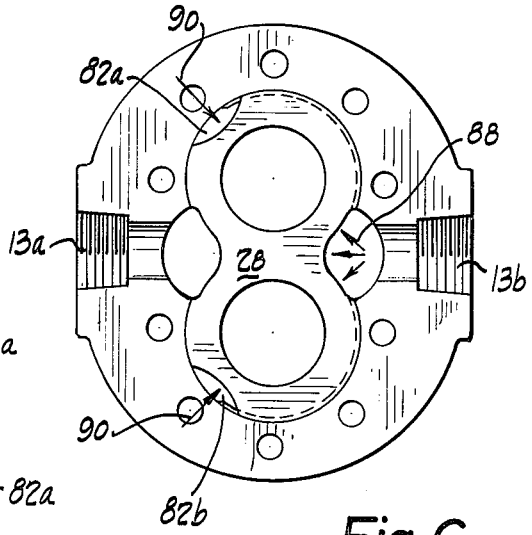
FIG. 6 is a view similar to FIG. 2, but showing the impeller structure removed and schematically illustrating the forces generated by high pressure fluid in the housing.

The end plates 26, 28 are identical. Therefore, only the end plate 26 will be described in detail. Referring specifically to FIGS. 3, 4 the end plate 26 is shown to comprise an inner face 70, and an outer face 72. The inner face 70 has a generally planar, smooth surface while the outer face 72 has a stepped surface which includes a pair of recesses 73. When the end plate 26 is assembled in the pump, the smooth inner face 70 is butted against the end faces of the impellers 14, 16 while the recesses 73 and the stepped surface 72 are adapted to receive the ends of the needle bearing assemblies 46. Circular apertures 76*a*, 76*b* in the generally circular portions 74*a*, 74*b* of the end plate 26 sliably receive the hub end portions of the impellers 14, 16.

In accordance with conventional practice, the end plate 26 is provided with a pair of T-shaped spaced return channels 78*a*, 78*b* formed in the smooth inner face 70. These channels return fluid trapped between the meshing impellers to regions of the pump adjacent the high and low pressure fluid ports.

Only one return channel 78*a*, 78*b* is employed at any one time by the trapped fluid. The channel to be employed communicates with the region of the pump housing through which the fluid trapped in the impellers has just passed. Two return channels 78*a*, 78*b* are provided so that the trapped fluid may escape from the meshing impellers whether the impellers are rotated in one direction or the other.

In accordance with the present invention, the smooth inner face 70 is formed with a pair of reaction chamber 82*a*, 82*b*. The reaction chambers 82*a*, 82*b* are defined by recesses machined in the smooth face 70 of the circular portions 74*a*, 74*b*, respectively of the end plate 26. The reaction chambers 82*a*, 82*b* are located adjacent to but spaced from the low pressure port 13*a*. No fluid communication is provided between the reaction chambers 82*a*, 82*b* and the low pressure port. The reaction chamber 82*a* is communicated with the high pressure side of the impellers 14, 16 by a channel 84*a* cut into the outer peripheral edge of the circular portion 74*a*. The reaction chamber 82*b* is communicated with the high pressure side of the impellers 14, 16 by a channel 84*b* formed in the outer peripheral edge of the circular portion 74*b*. When the end plate 26 is assembled in the pump housing 12, the termination points 86*a*, 86*b* of the channels 84*a*, 84*b* are in communication with the interior region of the pump housing proximate the high pressure port 13*b*. The channels 84*a*, 84*b* thereby provide communication between the reaction chambers 82*a*, 82*b* and the high pressure port of the pump housing 12.

Reaction forces generated by high pressure fluid at the high pressure port 13*b* of the pump act on the gear impellers and tend to force the impellers toward the low pressure side of the pump. The impeller structures flex and excessive pressures are exerted on parts of the impeller bearings by the uneven load thereon, thereby causing bearing wear and failures.

In the construction of the present invention, a portion of the high pressure fluid is diverted from the high pressure side of the pump to the reaction chambers 82*a*, 82*b* via the channel 84*a*, 84*b*. The high pressure fluid in the chambers 82*a*, 82*b* produces reaction forces on the impellers 14, 16 acting in the direction opposite to that produced therein by the high pressure fluid at the high pressure side of the impellers. These reaction forces counterbalance one another and thereby avoid the problems of shaft deflection, bearing wear etc. The location of the reaction chambers 82*a*, 82*b* on the smooth inner faces of the end plates causes the high pressure fluid therein to also push the end plates against the stationary end casing members, assists in centering the impellers in the pump chamber thus reducing or avoiding wear between the end plates and the impellers.

If desired three channels 92*a*, 92*b*, 92*c* may be cut in the stepped outer face 72 of each end plate (FIG. 4) for the reception of sealing members for preventing high pressure fluid in the region of the high pressure port from traveling around the outer surface of the respective end plate toward the low pressure port of the pump housing.

It will be apparent that this invention achieves the object of providing means for reducing the uneven load which is applied to the rotary structure of rotary fluid pumps and motors by high pressure generated forces acting in the direction of the high pressure fluid port. This invention is applicable to both a gear pump and to a modified form of an axial piston pump.

Many modification and variations of the invention will be apparent to those skilled in the art in the light of the foregoing detailed disclosure. Therefore, it is to be understood that within the scope of the appended claims, the invention can be practiced otherwise than is specifically shown and described.

What is claimed is:

1. An end plate for a gear pump or the like comprising a discrete plate member including two circular portions defining a figure eight configuration, each of said circular portions having a hole therethrough, a recess in the same side of each circular portion of said plate member and being located on the same side of a center line extending diametrically through said holes, and a channel in the outer peripheral edge of each circular portion of said plate member and spaced from the sides of said plate member and extending from said recesses in said plate members to a terminating location on the other side of said center line.

2. An end plate for use in a gear pump or the like between an end of the gears and the adjacent side of the pump housing, said end plate comprising a discrete plate member including two circular portions defining a figure eight configuration, each of said circular portions having a hole therethrough and a recess at or adjacent to the outer peripheral edge of each circular portion opening into a common side face of said plate member and being located on the same side of a center line extending diametrically through said holes, fluid conduit means in each circular portion of said plate member and spaced from the sides of said plate member and extending from said recesses to a terminating location on the other side of said center line.

3. A fluid motor or pump comprising housing means, at least two gear impellers having shaft means extending from opposite ends thereof rotatably mounted directly by bearings means in said housing means, said housing means having a low pressure side including a low pressure port on one side of said impellers and a high pressure side including a high pressure port on the opposite side of said impellers, discrete end plates not a part of said housing means or said bearing means in said housing means at opposite ends of said impellers, reaction chambers in the sides of said end plates facing said impellers and exposed to interdental spaces of said impellers adjacent to but spaced from said low pressure side, said reaction chambers being isolated from said low pressure side, and means in at least one of said side plates and spaced from opposite sides thereof providing fluid communication between said high pressure side and said reaction chamber therein.

4. In a rotary fluid pump or motor having a housing with a rotor chamber therein with opposed high pressure and low pressure sides and respective fluid delivery ports, gear impellers within the rotor chamber in the housing to direct fluid from one port to the other port and having shaft means extending from opposite ends thereof rotatably mounted directly by bearing means in said housing, discrete end plates in said chamber in said housing at the ends of the impellers and within which chamber forces are generated by high pressure fluid against the rotating impellers in the direction of the low pressure side, the method of counterbalancing such high pressure forces comprising channeling a portion of the high pressure fluid from the high pressure side through openings in the end plates spaced from the sides thereof to reaction chambers in the sides of the end plates facing the impellers adjacent to but out of communication with the low pressure side and spanning at least one interdental space.

5. In a fluid pump or motor including a stationary housing having a low pressure fluid port and a high pressure fluid port disposed on generally opposed sides of a chamber in said housing, rotatable gear impellers directly supported by bearings in said housing for impelling fluid between said high and low pressure fluid ports, and discrete end plates in said chamber in said housing at opposite ends of said impellers, the improvement, comprising: said end plates having recess means for receiving high pressure fluid, said recess means being contained within the sides of said end plates facing said impellers and being adjacent to but out of communication with said low pressure fluid port, said end plates having channel means for communicating the high pressure fluid port with said recess means, said channel means also being spaced from the sides of said end plates, said recess means being oriented for discharging high pressure fluid, received via said channel means, against said rotatable impellers and generally toward said high pressure port.

6. In a gear pump or motor comprising a housing having an impeller chamber between a low pressure port and a high pressure port, gear impellers located in said chamber between said ports and having shaft means extending from opposite ends thereof rotatably supported by bearing means directly in said housing, and discrete end plates not a part of said housing means or said bearing means located in said chamber between the ends of said impellers and the sides of said chamber, the improvement comprising: reaction chambers located on the sides of said end plates adjacent to interdental spaces of said impellers and isolated from said low pressure port, and means in at least one of said side plates and spaced from the opposite sides thereof communicating said reaction chamber therein with said high pressure port.

7. The gear pump or motor of claim 6 wherein each said end plate comprises a pair of similar circular portions arranged contiguously to define a figure eight configuration, each said circular portion having an inner face and an outer face, each said circular portion being aligned with one of said impellers so that the inner face of each said circular portion is in face-to-face relationship with an end face of said adjacent impeller, each of said reaction chambers being disposed in communication with said inner face and remote from said outer face of said end plate.

* * * * *